United States Patent [19]

Mason et al.

[11] Patent Number: 4,980,937

[45] Date of Patent: Jan. 1, 1991

[54] INFANT SITTING SUPPORT AND HEAD PROTECTION RING

[76] Inventors: Franklin P. Mason; Christina P. Mason, both of 974-B La Mesa Ter., Sunnyvale, Calif. 94086

[21] Appl. No.: 416,540

[22] Filed: Oct. 3, 1989

[51] Int. Cl.[5] ..... A47C 16/00; A47D 1/00

[52] U.S. Cl. ..... 5/431; 5/432; 5/436

[58] Field of Search ..... 5/93 R, 431, 432, 436, 5/446

[56] References Cited

U.S. PATENT DOCUMENTS

| | | | |
|---|---|---|---|
| 909,453 | 1/1909 | Pullman | 5/432 X |
| 1,769,722 | 7/1930 | Sutton | 5/432 X |
| 3,803,646 | 4/1974 | Newerowski | 5/93 R X |
| 3,840,916 | 10/1974 | Jennings | 5/432 |
| 4,788,726 | 12/1988 | Rafalko | 5/93 R |

*Primary Examiner*—Michael F. Trettel

*Attorney, Agent, or Firm*—Flehr, Hohbach, Test, Albritton & Herbert

[57] ABSTRACT

An infant sitting support and head protection ring for protecting the head of an infant that is trying to sit up but is not yet strong enough. Included are a primary ring configured to conform to the shape of the buttocks, legs and feet of a sitting infant so that the infant is held snugly, the ring being made of a soft yet supportive material. The ring also includes back and head support members provided integrally to the ring for supporting a sitting infant. The protection ring is configured so that when an infant falls, its head falls upon the soft ring.

17 Claims, 2 Drawing Sheets

INFANT SITTING SUPPORT AND HEAD PROTECTION RING

FIELD OF THE INVENTION

The present invention relates to an infant sitting support device that allows an infant to sit alone safely and comfortably during those development stages when the infant is not yet capable of sitting erect. More specifically, the present invention relates to a sitting support device which protects an infant when the infant falls over from a sitting position as the infant learns to sit alone with confidence.

SUMMARY OF THE PRIOR ART

The prior art is replete with comfortable and functional devices for an infant or a child. These include inflatable cribs, bassinets, pillows, bean bag chairs, etc. Although these devices are very useful in their own right, they fail to address a problem which is becoming increasingly recognized by the medical profession.

That problems involves the time period from two months to nine months when a child is learning how to sit. The problem is that as the child attempts to sit but is not yet strong enough the child will fall over, banging its head in the process. The harder the surface contacted by the infant's head, the greater the potential damage. At a minimum, tumbles onto a hard surface may scare an infant and dampen its motivation to perfect its sitting skills. More substantially, the falls can result in minor injury to the infant such as minor head bruises. Also, the falls usually result in frustration for the infant, which is usually accompanied by tears that can be stopped only by attention from an adult. Placing a convenient pillow behind the infant might prevent a backward fall but other falls are almost inevitable. Generally, therefore, attending to an infant who wants to sit alone, but cannot as yet do so with confidence, requires nearly a full-time effort.

There are several devices which are directed towards the comfort of a child during infancy. They do not, however, provide support during this critical stage of development. For example, a Portable Crib such as that described in U.S. Pat. No. 3,833,947, and similar devices, is not suitable as an infant sitting support. Portable cribs are designed to allow an infant to lie safely, not to sit safely. They generally have a mattress that is raised from the floor and sides high enough to contain an infant only in the lying position. Additionally, such cribs are, naturally, large enough to accommodate an infant when he or she is lying down. The sides do not fit snugly around the infant when he or she is sitting nor are the sides high enough to support a sitting infant. Thus, if such a crib were used to hold a sitting infant, the infant would not only fall over within the crib, but would likely fall out of the crib from the elevated height of the mattress. This would make the fall potentially more dangerous and more traumatic than if no device were used at all.

Similarly, an Infant Rest Pad disclosed in U.S. Pat. No. 3,761,975, and similar devices, is not suitable as an infant sitting support. Although it does not have a raised mattress, the inner walls of the device are at an obtuse angle with alternating lobes and pockets. Therefore, they are not suitable for supporting a sitting infant. And again, the walls are designed to hold a lying infant, not one who is sitting. U.S. Pat. 3,513,489, relates to a Portable Bassinet with walls that are sufficiently high and strong to support an infant in the sitting position. However, as before, the walls of the bassinet are designed to hold a lying infant, not one who is sitting. Therefore, the infant can fall over within the bassinet giving rise to tears and the need for adult attention. In addition, the walls of the bassinet are too high for an infant to see its surrounds easily.

Relevant prior art also includes U.S. Des. Pat. 240,137, which discloses a Baby Retaining Device. The baby retaining device has a circular shape, however, the inner walls of the retaining device are at such an obtuse angle that they would not support the infant's back in the upright sitting position. In addition, the device has no raised and buttressed back to provide the support necessary for a younger infant, who is in the earliest stages of learning to sit alone.

Lastly, the prior art includes U S. Pat. 3,902,456 which discloses a Pet Pillow. Whereas a pet pillow has a circular shape, the walls of a pet pillow are low and unsubstantial. The walls are necessarily low to allow the pet easy access to the central portion of the pillow. Such low walls, however, would not provide the support necessary to hold a sitting infant. Also, the walls of such devices are generally unsubstantial because they are designed to provide comfort to a lying animal, rather than provide support to a sitting infant.

SUMMARY OF THE INVENTION

It is a general object of the present invention to provide an infant sitting support that is safe, secure, comfortable and portable.

It is another object of the present invention to provide an infant sitting support as above that will be useful as a sitting support from the infant's first attempts to sit alone until his or her first attempts to crawl.

These and related objects are achieved through use of the novel infant sitting support and head protection device disclosed herein. The infant sitting support and head protection device has a circular or oval doughnut-shaped ring with an attached bottom. The back wall of the ring is raised and is widened at its base to provide support for a sitting infant. The side and front walls of the ring are high enough and wide enough to catch and support an infant when it falls, but low enough for the infant to see over them easily. The interior walls of the ring are generally perpendicular to the ground to provide support. The bottom is padded for comfort. The infant sitting support is circular or oval (preferably oval) to conform to the shape of the buttocks, legs and feet of a sitting infant so that the infant is held snugly on all sides. The sitting support can be made of any suitable material such as pillow-like material, in which case it weighs only a few pounds. The sitting support can be placed on any floor surface.

DETAILED DESCRIPTION OF THE PREFERRED EMBODIMENT

Figure 1:
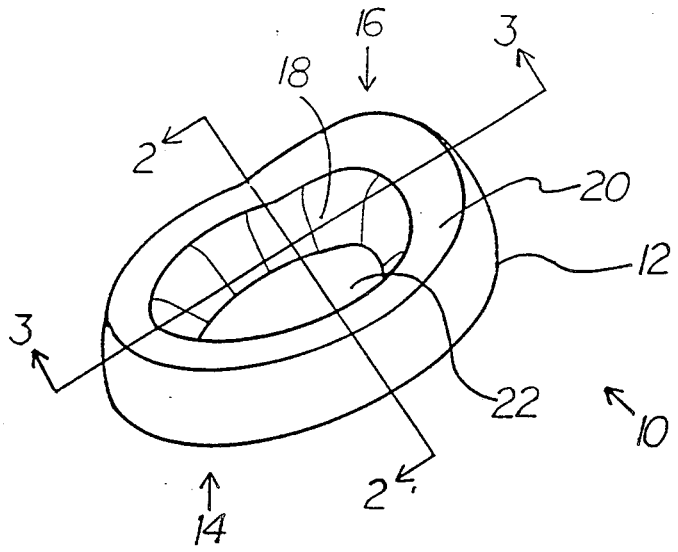
FIG. 1 is a perspective view of the infant sitting support device of the preferred embodiment.

Referring to FIG. 1, a perspective view of the preferred embodiment of the infant sitting support device 10 is shown. The device 10 is beautifully simple in construction, being comprised of a few key components which are constructed with rather precise dimensions. The infant sitting support device (hereinafter "bolster") 10 is essentially comprised of a carefully tailored doughnut-shaped ring 12 which fits around an infant. The preferred embodiment also contains a padded bottom 22 affixed to the ring 12.

The ring 12, and more specifically its inside wall 18, are configured with such dimensions that they fit comfortably yet securely around an infant in the sitting position. The ring 12 may be circular or oval, but is preferably oval to conform to the shape of the buttocks, legs and feet of a sitting infant sc that the infant is held snugly on all sides.

The ring 12 is configured to have the same general height ($h_n$ for normal height) around a substantial portion of itself. An elevated portion, however, is also provided towards the rear of the bolster 10. The elevated portion 16, towards the back of the bolster, constitutes a back and head rest to provide support to an infant as it sits in an upright position or as it moves from a lounging to a sitting position. As noted more accurately in FIG. 2, the rear section 16 is wider than the normal portion 14 of the ring 12.

The top 20 of the ring 12 is generally flat but may have a gentle slope emanating from a central high point rimming the ring 12, particularly towards the elevated section 16 of the ring 12. The flat top 20 provides two primary purposes. When a child is sitting in the bolster 10, its buttocks region is usually placed towards the rear or elevated portion 16 with its feet directed towards the front or normal portion 14. The height of the bolster is such that with an infant sitting with its rear towards the elevated portion 16, the flat top 20 functions as an armrest for the infant. The infant may sit comfortably resting its arms on the flat top 20 or may grasp the flat top while moving from a lounging to a sitting position. The flat top 20 constitutes a relatively large area with respect to the infant, giving the infant plenty of space with which to support itself as it attempts to rise. Also, the large surface area of the top 20 permits a large landing area for the head of the infant as it tumbles over from an attempt at sitting. Regardless of which direction the infant falls, its head will come squarely in contact with the top 20. The relatively large area of the strip 20 provides a more even distribution of the impact force. It is also comfortable and allows the infant an opportunity to rest before once again trying to erect itself or to place itself in a more comfortable position.

The exterior of the bolster 10 is made of a soft, yet durable material, for instance, corduroy cloth. The interior of the bolster 10 is made of any suitable pillow-like material. In the preferred embodiment, firm, polyester batting is used. However, these are several other suitable products, e.g., foam, feather, or other synthetic or natural fibers.

Figure 2:
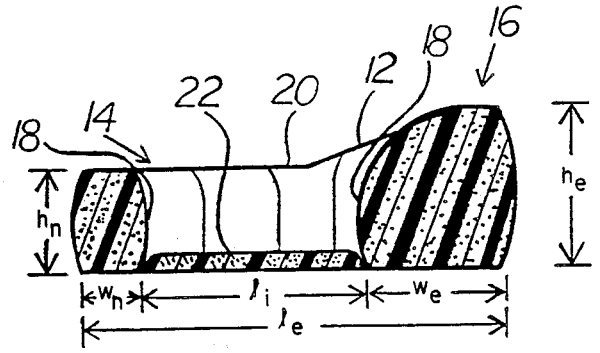
FIG. 2 is a cross-sectional view of the infant sitting support device of the preferred embodiment taken at line A—A of FIG. 1.

Referring to FIG. 2, the bolster 10 of the preferred embodiment is shown in the cross-section along line A—A of FIG. 1. It is quite evident from this perspective that the elevated portion 16 is not only higher, but it is significantly wider than the normal portion 14. The extra width at the elevated portion 16 provides extra support to the back and head of an infant. The height of the elevated portion, designated by he, is approximately 11 inches, but may vary depending on the size of an infant which it is created for and the material utilized in its construction. In the preferred embodiment, the width of the elevated portion $w_e$ is approximately 8 inches. Again, this width may vary depending on infant size and materials used.

In contrast, the height of the normal portion 14 is approximately 8 inches and the width of the normal portion is approximately 4 inches. These measurements similarly may vary. With respect to the material used in construction, the firmer the material, the slimmer the ring 12 may be in width. Regardless of the material firmness, however, the ring must still be wide enough to support a region such as strip 20 which is both wide enough to protect the infant's head as it topples over and also serves as an armrest or support for an infant. The height $h_n$ is such that an infant sitting in the bolster 10 with its back towards rear portion 16 can see easily over the front portion 14 of the ring 12. The height $h_e$ of the elevated portion 16 is such that the back and possibly head of the child are supported as it leans or rests backward upon the elevated portion 16. There is a slope from elevated portion 16 down to the normal portion 14. This slope occurs just about where an infant's arms would rest in the sitting or resting position. Points higher along this slope contact the infant's arm at a higher point, points lower upon this slope, i.e., closer to the normal surface 14, contact the forearm of the infant.

A more critical measurement than the width of the various portions of the ring 12 is the interior length $l_i$ of the bolster 10. The length of the interior $l_i$ is approximately 17 inches, but may be altered to accommodate different size infants. A range of 14 to 20 inches is perhaps, appropriate. This range is necessary because infants come in all sizes. But the underlying principle is that the distance $l_i$ should be such that an infant can sit comfortably yet securely within the bolster with its back towards upper portion 16 and is legs stretched out towards the normal portion 14. The overall length or $l_e$ for external length, in the preferred embodiment, is approximately 28 inches. As noted before, this length is arbitrary, depending upon the materials used and infant sizes, but must provide both an armrest and ample surface area to receive the head of a toppling infant.

The bottom 22 is also shown in cross-section along its longest axis. The bottom 22 is oval-shaped, similar to that of ring 12, it is affixed to the bottom of ring 12. Bottom 22 is provided for several reasons. One, is that its padded condition provides a comfortable place to sit. Second, it prevents the infant from digging out from underneath the bolster 10, either by planting its feet under the normal section 14 or through some other avenue. Note, it is conceivable that the bottom portion of the bolster 10 could be heavily weighted to prevent an infant from tunneling under the bolster, however, this may be undesirable because of the added weight, among other reasons. Third, by making the bottom out of the same material as the ring 12 it instills in an infant a slightly greater feeling of security and all the comforts which come therewith.

Figure 3:
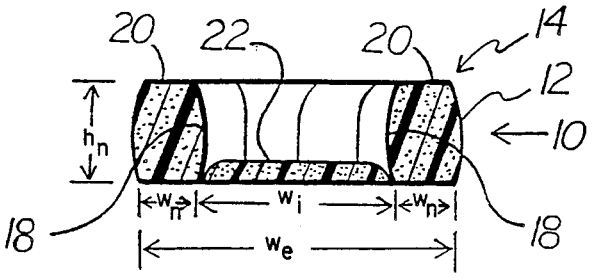
FiG. 3 is a cross-sectional view of the infant sitting support device of the preferred embodiment taken at line B—B of FIG. 1.

Referring to FIG. 3, a cross-sectional view of the bolster 10 of the preferred embodiment is shown taken at line B—B of FIG. 1 herein. The perspective of FIG. 3 shows generally the interior and exterior width of the bolster 10. The interior width of the bolster 10 is approximately 13 inches. Such a measurement is only a guideline, the principal width being that which securely, but comfortably fits around the legs of an infant which are positioned in the normal flexed diamond shape. From the perspective of FIG. 3, an infant's legs would be situated towards the normal portion 14, which is that portion illustrated in FIG. 3. The external width of the bolster 10 is approximately 21 inches. Again, this dimension is not as crucial as the interior width and may be changed depending on the material used or other considerations, but at a minimum must provide a surface 20 which both serves to cushion the fall of an infant, particularly the infant's head, and also acts as an armrest or surface from which an infant may brace itself towards the sitting position. The height $h_n$ of the bolster 10 is the same as that appearing in FIG. 2. Similarly, the widths $w_n$ of the ring 12 are also the same as the width $w_n$ in FIG. 2. The bottom 22 appears in cross-section along the axis of its width. It is as described with respect to FIG. 2. The strip 20 is shown in cross-section and rotates around between the two cross-sectional elements of the ring 12. As is evident from both FIGS. 2 and 3, the interior wall 18 is generally perpendicular to a horizontal surface on which the bolster would be placed, thereby providing support to the infant. The bolster 10 may be placed on any floor surface.

Figure 4:
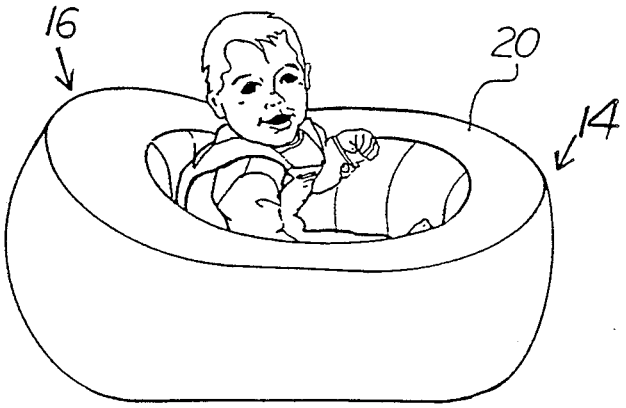
FIG. 4 is a perspective view of the infant sitting support device of the preferred embodiment with a child sitting therein.

Referring to FIG. 4, the baby bolster 10 of the preferred embodiment is illustrated with an infant sitting therein. The bolster 10, in FIG. 4, is situated opposite to that of FIG. 2. Accordingly, the elevated section 16 is to the left of the picture and the normal portion 14 to the right. For maximum comfort and protection, an infant is positioned in the bolster 10 with its back toward the rear section 16 and its feet extending toward the normal section 14. The dimensions of the bolster 10 are such, however, that even if the infant were placed with its back toward the normal portion 14 and its feet toward the rear section 16, its head would still be protected should the infant topple over. When seated as depicted in FIG. 4, an infant attempting to sit erect may comfortably lean its head and back against the rear portion 16 when it tires. Similarly, the child may brace against the top 20 when trying to sit, or may rest on that portion 20 after an unsuccessful attempt.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. An infant sitting support and head protection apparatus, comprising:

oval ring means configured to fit securely around the body of an infant of approximately three to nine months of age and to hold the infant in a sitting position, said oval ring means having a continuous inner wall securely surrounding said infant;

a generally planar portion situated primarily on top of said oval ring means and connected to said inner wall, said generally planar portion having at least a front and back section, said front section having a sufficiently adequate width to protect the head of a toppling infant;

said back section being (1) sufficient in elevation to engage the head of an infant as a head rest and (2) sufficient in surface area to support the head of an infant as a head rest;

wherein the head on an infant is directly supported by said back section when said child is in a lounging position; and bottom means securely fastened to a bottom of said oval ring means.

2. The apparatus of claim 1 wherein said oval ring means conforms to the shape of the lower portion of sitting infant so that said infant is held snugly on all sides, said lower portion consisting primarily of the infant's buttock, legs and feet.

3. The apparatus of claim 2 wherein said oval ring means has an interior and exterior, said interior surrounding said bottom means and having substantially vertical inner walls to support said lower portion of said infant.

4. The apparatus of claim 1 wherein said ring means is generally circular.

5. The apparatus of claim 1 wherein base of said a back section is widened to provide support for a sitting infant.

6. The apparatus of claim 1 wherein said bottom means is padded.

7. The apparatus of claim 1 wherein said oval ring means is made of a soft yet supportive material, thereby protecting the infant's head during a fall.

8. The apparatus of claim 7 wherein said soft yet supportive material is firm polyester batting.

9. An infant sitting support device for protecting the head of an infant that is learning to sit erectly, comprising:

ring means having a specific interior width and length measurement configured to conform to the shape of the buttocks, legs and feet of a sitting infant approximately between the ages of three months and nine months so that said infant is held comfortably and securely; and receiving means encircling a top portion of said ring means and having a sufficient height, width and compressive strength for comfortably receiving the head of a infant when said infant topples from a sitting position;

wherein said ring means and said receiving means are configured of a specific height and width to form a head support means for an infant in a lounging position.

10. The apparatus of claim 9 wherein said ring means is oval.

11. The apparatus of clam 9 wherein said ring means is circular.

12. The apparatus of claim 9 wherein said specific interior width is in a range of 10 to 16 inches.

13. The apparatus of claim 9 wherein said specific interior length is in a range of 14 to 20 inches.

14. The apparatus of claim 9 wherein said ring means further comprises:

padded bottom means connected to said ring means.

15. The apparatus of claim 9 wherein a surface of said ring means is made of cloth.

16. The apparatus of claim 9 wherein an interior of said ring means is made of polyester batting.

17. An apparatus for teaching how to sit erect, comprising:

head rest means extending above an infant enclosing ring;

generally planar portion located primarily on top of said infant enclosing ring having a first and second section;

said first section of said planar portion incorporating said head rest means and being of a sufficient area and height to support the head of a lounging infant;

said second section of said generally planar portion being lower in height than said first section and configured of a sufficient width and compressive strength to comfortably absorb the head of a toppling infant sitting in said infant enclosing ring;

said infant enclosing ring being configured to comfortably and securely hold the buttocks and extended legs of approximately a three to nine month old infant and being filled with a soft and firm material;

wherein said infant enclosing ring and said generally planar portion cooperate in height, width and softness to comfortably and completely receive the head of a toppling infant.

* * * * *